US005442832A

United States Patent [19]

Tonsager

[11] Patent Number: 5,442,832

[45] Date of Patent: Aug. 22, 1995

[54] ADJUSTABLE TROWEL

[76] Inventor: Wayne M. Tonsager, 24311 Natchez Ave., Lakeville, Minn. 55044

[21] Appl. No.: 229,778

[22] Filed: Apr. 19, 1994

[51] Int. Cl.[6] ..... E01C 19/12

[52] U.S. Cl. ..... 15/235.7; 15/235.8

[58] Field of Search ..... 15/235.4, 235.7, 235.8; 16/269, 221, 264, 265, 348; 294/3.5; 404/97, 118

[56] References Cited

U.S. PATENT DOCUMENTS

| | | | |
|---|---|---|---|
| 109,073 | 11/1870 | Streeter | 15/235.7 |
| 398,781 | 2/1889 | Hovey | 15/235.7 |
| 684,578 | 10/1901 | Lucas | 15/235.8 |
| 1,370,060 | 3/1921 | Smith | 15/235.7 |
| 1,383,688 | 7/1921 | Word | 15/235.7 |
| 1,423,455 | 7/1922 | Rivers et al. | 16/269 |
| 1,831,988 | 11/1931 | Aldeen | 16/269 |
| 2,178,899 | 11/1939 | Shaffer | 15/235.7 |
| 2,608,853 | 9/1952 | Schrepper | 15/235.8 |
| 2,795,349 | 6/1957 | Cawood | 16/269 |

FOREIGN PATENT DOCUMENTS

| | | | |
|---|---|---|---|
| 1241176 | 7/1971 | United Kingdom | 16/221 |
| 1563651 | 3/1980 | United Kingdom | 16/269 |

*Primary Examiner*—David A. Scherbel
*Assistant Examiner*—Tony G. Soohoo
*Attorney, Agent, or Firm*—Haugen and Nikolai

[57] ABSTRACT

An adjustable trowel for applying sheet rock joint compound to corners between intersecting sheet rock panels comprises first and second planar blade members that are hinged together along a common intersection line and which includes a handle member for grasping the trowel and for holding a desired angle between the two blade members. The blade members and hinge elements associated therewith are symmetrical such that two identical pieces can be joined together in forming the trowel.

7 Claims, 2 Drawing Sheets

ADJUSTABLE TROWEL

BACKGROUND OF THE INVENTION

1. Field of the Invention

This invention relates generally to a trowel-type hand tool for use in applying and smoothing joint compound between two gypsum board panels that intersect one another at an angle.

2. Discussion of the Prior Art

Various hand tools exist for applying, smoothing and leathering out joint compound during the construction of building spaces using so called dry wall or gypsum board panels. Where the joint to be finished is between two panels lying in the same plane, a planar trowel is commonly used. It generally comprises a thin steel rectangular sheet having a handle affixed thereto or a relatively wide putty knife. Where the two sheets of dry wall meet at a right angle, there are also available a trowel comprising a thin sheet metal member that is bent along a midline to define two planar surfaces meeting at a fixed 90 degree angle. Again, a handle is affixed to the sheet metal member to facilitate the positioning of the trowel in a corner joint and drawing it along the joint as joint compound is applied.

In many instances, dry wall panels are not oriented only at 180 degrees and at 90 degrees relative to one another, making it necessary for a tradesman to carry several trowels for accommodating a wide variety of angles. It, therefore, would be advantageous to have a single trowel for applying dry wall joint compound that is adjustable so that it can be used in creating a smooth, visually imperceptive joint between abutting surfaces intersecting at a variety of angles.

SUMMARY OF THE INVENTION

In accordance with the present invention, there is provided an adjustable trowel comprising first and second planar blade members having a hinge coupling the blade members together about a common edge so that the blade members are free to rotate between first and second limiting angular positions. A handle cooperates with the first and second planar blade members so as to releasably lock them together with a desired angle therebetween which falls between first and second limiting angles.

Further in accordance with the present invention, the first and second planar blade members are identical to one another and each includes a plurality of integral, spaced apart tabs extending along an edge thereof, the spaced apart tabs being bent at a predetermined angle to the plane of the planar blade members. The tabs on the first blade member interlock with the tabs on the second blade member to create the hinge coupling. Brackets are secured to the rear face of each of the first and second blade members and those brackets each have an arcuate slot formed therein. When the two blade members are hinged together via the interlocking tabs, the brackets on the first blade member are juxtaposed adjacent the bracket on the second blade member and with the arcuate slots in each aligned, allowing a threaded bolt on the handle to pass through the arcuate slots. A nut is then screwed onto the threaded rod to clamp the blade members at an adjustable desired angle to one another.

DESCRIPTION OF THE DRAWINGS

The foregoing features, objects and advantages of the invention will become apparent to those skilled in the art from the following detailed description of a preferred embodiment, in which like numerals in the several views refer to corresponding parts.

DESCRIPTION OF THE PREFERRED EMBODIMENT

Figure 1:
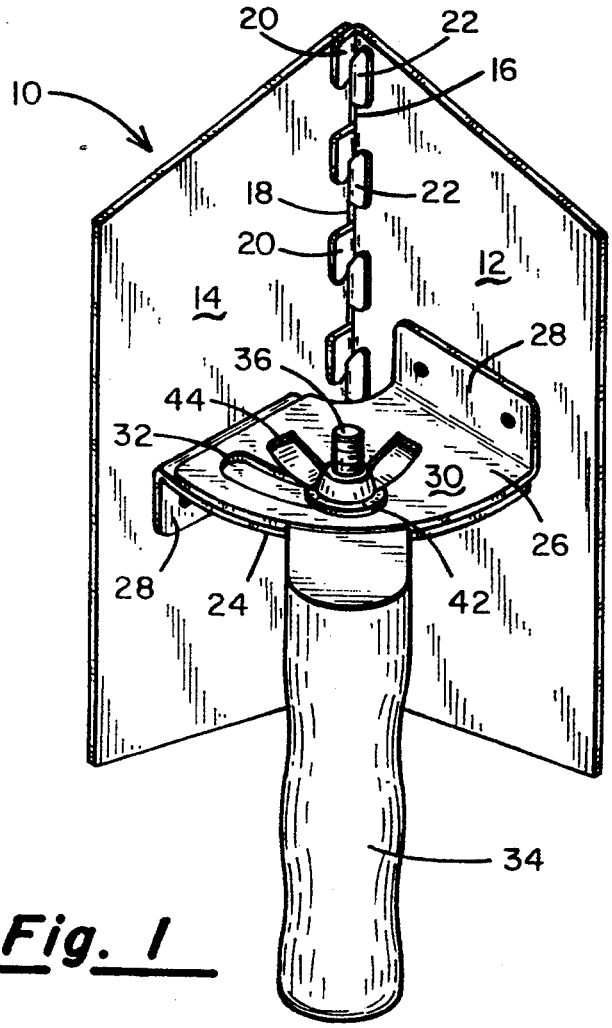
FIG. 1 is a perspective view of the adjustable trowel in accordance with the present invention.
Figure 3:
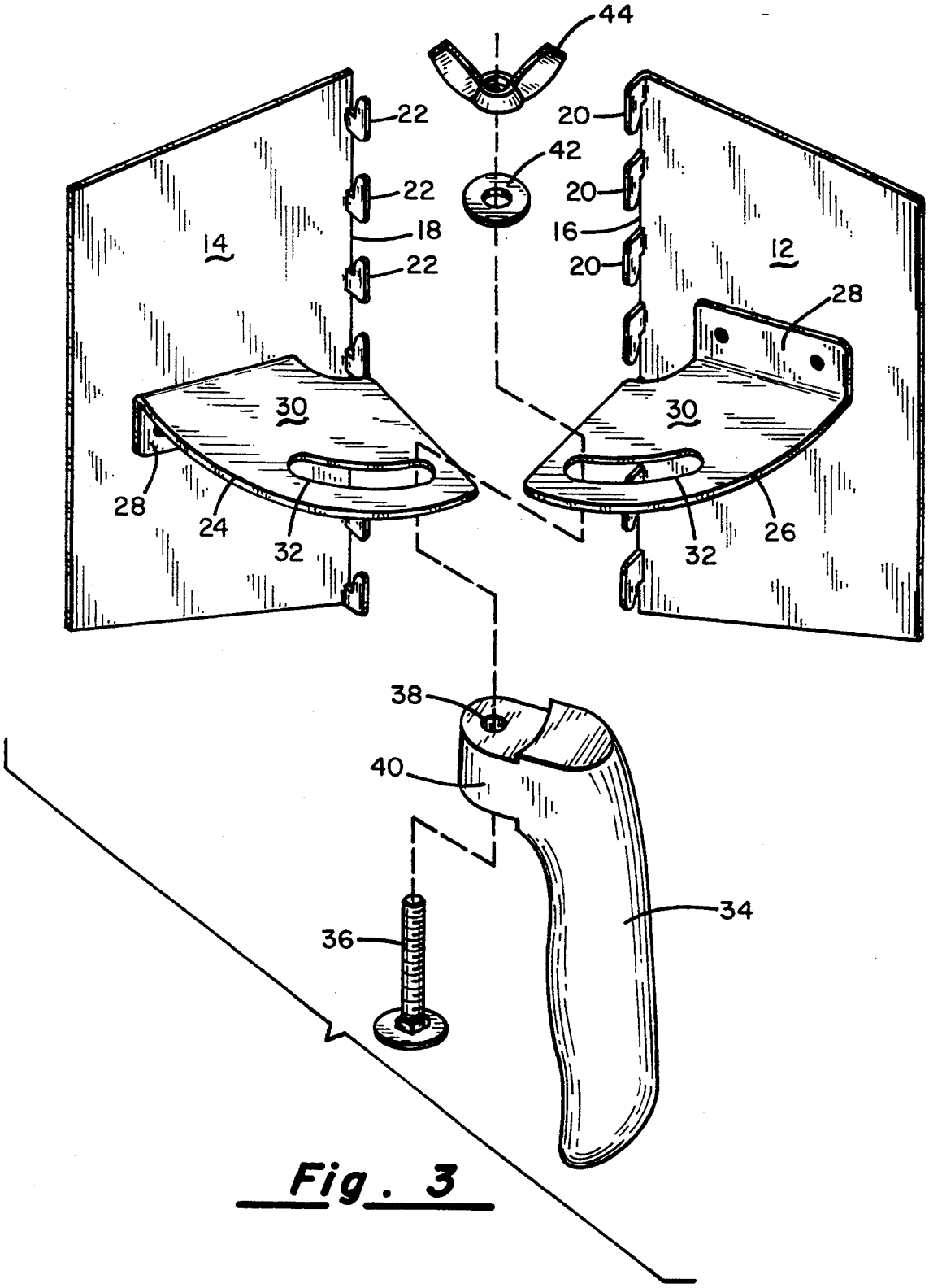
FIG. 3 is an exploded view of the adjustable trowel.

Referring first to FIG. 1, there is indicated generally by numeral 10 an adjustable trowel constructed in accordance with the present invention. It is seen to comprise a first and second trapezoidal-shaped, planar blade members 12 and 14 hinged together along adjacent edges 16 and 18. The hinge itself comprises interlocking, generally L-shaped tabs 20 on the edge 16 of the first planar blade member 12 and identical L-shaped tabs 22 formed along the edge 18 of the second planar blade member 14. As seen more clearly in the exploded view of FIG. 3, the tabs on each of the blade members are uniformly spaced from one another and are bent at a predetermined angle in the range of from about 85 degrees to 95 degrees to the plane of the respective blade member. When the first and second planar blade members are inverted relative to one another the L-shaped tabs on blade member 14 are inserted in an interdigital manner into the spaces between adjacent tabs on blade member 12 and then shifted longitudinally, the L-shaped tabs interlock with one another, as shown in FIG. 1, to create a hinge.

Spot welded or otherwise affixed to the non-working surface of each of the blade members 12 and 14 proximate to midsections thereof are brackets 24 and 26. These brackets are identical and include a generally rectangular flange portion 28 which joins to the back surface of the blade members 12 and 14 and an outwardly projecting arcuate portion 30 having an arcuate slot 32 formed through the thickness dimension thereof.

The handle for the adjustable trowel is identified by numeral 34 and is formed from wood, plastic or other suitable material and shaped to conform to the hand when the user's fingers are clasped about it. The handle member 34 is secured to the blade members by a bolt 36. It passes through a bore 38 formed through a leg portion 40 of the handle and through the arcuate slots 32 formed in the brackets 24 and 26 which become aligned when the blade members 12 and 14 are hinged to one another. A washer 42 and a wing nut 44 are screwed onto the bolt 36 and when tightened, squeeze the arcuate segments 30 of the brackets 24 and 26 tightly against one another, preventing rotation of the blade members about their hinge.

Figure 2:
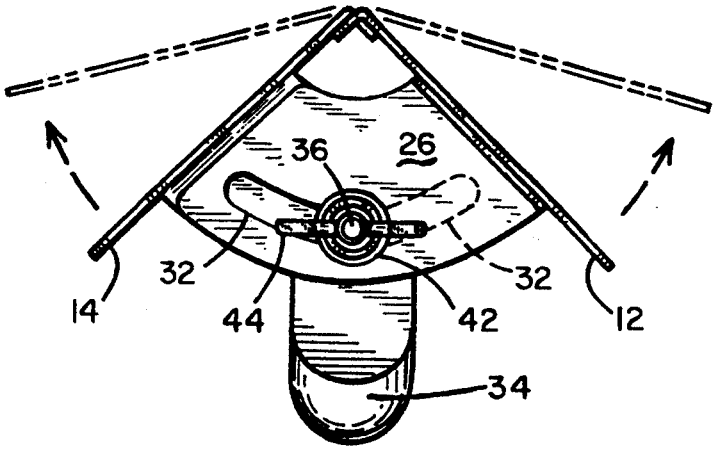
FIG. 2 is an end view of the trowel of FIG. 1 illustrating the adjustability feature thereof.

With reference to FIG. 2, it can be seen that when the wing nut 44 is loosened slightly, it is possible to adjust the angle of intersection between the blade members 12 and 14 anywhere between a first limiting position shown in solid line to a second limiting position illustrated in phantom line. In use, with the wing nut slightly loosened, the sheet rock worker will position the trowel in the corner to be finished and the blades 12 and 14 will shift to assume the angle defined by the intersecting sheet rock panels. The worker will next tighten the wing nut 44 to maintain the desired angle as the trowel is used to spread and feather joint compound into that corner. Because of the adjustability feature, the same tool can be used to finish the joint between panels intersecting at angles in the range from between about 85 degrees and 150 degrees.

The leading and trailing edges of the blade members are preferably at a predetermined angle of about 15 degrees to the hinge edge to form a trapezoidal shape to the planar blade surfaces. It is found that this blade shape facilitates placement of the trowel close to ceiling and floor lines.

It is an important advantage of the present invention that the blade members 12 and 14 along with their integrally formed hinge tabs 20 and 22 and affixed brackets 24 and 26 are identical and thus, there is no need to have separate tooling for preparing the two hinged halves of the trowel 10. This greatly reduces the manufacturing cost of the tool.

While the preferred embodiment of the present invention has been explained in connection with a trowel designed for use in working with the joint between sheet rock panels, those skilled in the art can appreciate that the tool of the present invention may also be used for finishing concrete. Still other uses may be found for it as well.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed:

1. An adjustable trowel comprising:

(a) first and second generally identical planar blade members, each including a plurality of integrally formed, flat, generally L-shaped tab members projecting out of the plane of said first and second blade members along one edge thereof at a predetermined angle, the tab members being equally spaced from one another by a predetermined distance and engaged in interdigitated, interlocking relationship whereby said L-shaped tabs members of the first planar blade member are oriented in an inverted relationship relative to said L-shaped tab members of said second planar blade member, and forming a pinless hinge coupling of said first and second planar blade members, and (b) handle means cooperating with said planar blade members for releasably locking said planar blade members together with a desired angle therebetween, the desired angle lying between first and second limiting angles.

2. The adjustable trowel as in claim 1 wherein said flat, L-shaped tab members project at a predetermined angle to the planar blade member that is in the range of from about 85 degrees to 95 degrees.

3. The adjustable trowel as in claim 1 and further including brackets secured to each of said first and second planar blade members, said brackets each having an arcuate slot formed therein, the bracket on said first planar blade member being juxtaposed adjacent the bracket on said second planar blade member with the arcuate slots in each bracket aligned when said first and second planar blade members are in hinged relation.

4. The adjustable trowel as in claim 1 wherein said handle means includes:

(a) a threaded rod dimensioned to pass through said arcuate slots in said brackets when aligned; and (b) a nut adapted to be screwed onto said threaded rod for affixing said handle means to said brackets and clamping said blade members at an adjustable desired angle to one another.

5. The adjustable trowel as in claim 1 where said blade members are stainless steel.

6. The adjustable trowel as in claim 1 wherein said planar blade members are trapezoidal and said plurality of L-shaped tabs extend along a major base of the trapezoid.

7. The adjustable trowel as in claim 1 wherein said limiting angles fall between about 85 degrees and 150 degrees.

* * * * *